US009106028B2

(12) United States Patent
Matsumoto et al.

(10) Patent No.: US 9,106,028 B2
(45) Date of Patent: Aug. 11, 2015

(54) CONNECTOR FOR A MEMORY CARD

(75) Inventors: Yasuyoshi Matsumoto, Kanagawa (JP); Mitsuhiro Tomita, Kanagawa (JP); Takashi Fujikawa, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 250 days.

(21) Appl. No.: 13/513,873

(22) PCT Filed: Dec. 8, 2010

(86) PCT No.: PCT/US2010/059594
§ 371 (c)(1),
(2), (4) Date: Sep. 7, 2012

(87) PCT Pub. No.: WO2011/072090
PCT Pub. Date: Jun. 16, 2011

(65) Prior Publication Data

US 2013/0005167 A1 Jan. 3, 2013

(30) Foreign Application Priority Data

Dec. 8, 2009 (JP) ..... 2009-278166

(51) Int. Cl.
*H01R 24/00* (2011.01)
*H01R 12/71* (2011.01)
*H01R 12/70* (2011.01)

(52) U.S. Cl.
CPC ..... *H01R 12/714* (2013.01); *H01R 12/7094* (2013.01)

(58) Field of Classification Search
USPC ..... 439/188, 630, 159
IPC .. H01R 2103/00,13/7032, 24/46; G06K 7/0021
See application file for complete search history.

(56) References Cited

U.S. PATENT DOCUMENTS

| | | | | |
|---|---|---|---|---|
| 6,059,592 | A * | 5/2000 | Inadama | 439/188 |
| 6,431,893 | B1 * | 8/2002 | Chang et al. | 439/188 |
| 6,890,198 | B2 * | 5/2005 | Kawahata et al. | 439/188 |
| 6,896,532 | B2 * | 5/2005 | Chang | 439/188 |
| 7,708,598 | B2 * | 5/2010 | Hu | 439/630 |
| 7,997,913 | B2 * | 8/2011 | Ida et al. | 439/159 |
| 2008/0287004 | A1 | 11/2008 | Miyamoto et al. | |

FOREIGN PATENT DOCUMENTS

| | | |
|---|---|---|
| EP | 0 926 769 A1 | 6/1999 |
| EP | 1 182 743 A1 | 2/2002 |
| JP | 2008-084624 | 4/2008 |

OTHER PUBLICATIONS

International Search Report for PCT/US2010/059594.

* cited by examiner

*Primary Examiner* — Hien Vu

(57) ABSTRACT

A connector for a card having a housing for housing a card equipped with a terminal member, a connection terminal attached to the housing for contacting the terminal member of the card and a detecting switch equipped with a first contact member and a second contact member for detecting separation from each other and the insertion of a card into the housing, wherein at least the first contact member or the second contact member is equipped with a fixed portion fixed to the housing and a moving portion displaceable by the housing and unevenly mated with the housing.

10 Claims, 8 Drawing Sheets

(a)

(b)

CONNECTOR FOR A MEMORY CARD

REFERENCE TO RELATED APPLICATIONS

The Present Application claims priority to prior-filed Japanese Patent Application No. 2009-278166, entitled "Connector For Card," and filed 8 Dec. 2009, the contents of which is fully incorporated in its entirety herein.

BACKGROUND OF THE PRESENT APPLICATION

The Present Application relates, generally, to a connector for a memory card, and more specifically, to a memory card connector with an easily-manufactured configuration which does not increase the number of components, yet is able to reliably detect a card without malfunctioning.

Electronic devices such as personal computers, cell phones, personal digital assistants (PDAs), digital and video cameras, music players, gaming devices and onboard navigational devices are equipped with connectors that can accept a variety of memory cards. Types of memory cards include Subscriber Identity Module cards, Multimedia cards, Secure Digital cards, MiniSD cards, xD-Picture cards, Memory Sticks, Smart Media and MicroSD cards. An example of a conventional connector is disclosed in Japanese Patent Application No. 2008-84624.

FIG. 8 illustrates a perspective view of a conventional connector. Referring to FIG. 8, an end of the memory card, not shown, is inserted from the lower left to the upper right. A shell consisting of a metal sheet is mounted on the upper side of the insulated housing 811 (the shell is omitted here in order to show the interior configuration). A plurality of terminals 851, mounted on the insulated housing 811, contact the contact pad of the memory card. A protruding portion engages a portion of the memory card and slides along the side 811*c* of the insulated housing 811. A slider 821 in the card eject mechanism is biased by a coil spring 881 towards the lower left. A detection switch is arranged on the inner wall 811*a* of the insulated housing 811 to detect the presence of a memory card. The detection switch has an elastic first moving contact member 852 and an elastic second moving contact member 853, which are separated from each other and turned off when a memory card has not been inserted into the insulated housing 811. When a memory card has been inserted, the end portion of the memory card applies pressure which displaces the moving contact members 852, 853, establishing contact between them and turning on the detection switch. Thus, the insertion of a memory card can be detected.

SUMMARY OF THE PRESENT APPLICATION

However, in a typical connector, the moving contact members 852, 853 consist of slender sheets: The base ends are fixed and the free ends at some distance from the base ends are displaced. When an electronic device containing this connector is dropped to the floor, the connector is subjected to strong impact. This vibrates the free ends of the moving contact members 852, 853, and causes the detection switch to malfunction. When the vibration causes the free ends of the moving contact members 852, 853 to remain in contact, the detection switch remains on whether or not a memory card has been inserted. If the free ends of the moving contact members 852, 853 are displaced upward and make contact with the shell connected to the ground line, the detection switch remains off whether or not a memory card has been inserted. If contact between the free ends of the moving contact members 852, 853 cannot be released, the detection switch in its initial state cannot return to the off state.

These problems can be prevented if the length of the moving contact members 852, 853 is shortened and the amount of displacement at the free ends is reduced. However, the free ends would have to be subjected to spring action in order for the detection switch to remain reliable. Accordingly, in order to ensure the spring length, the lengths of the moving contact members 852, 853 have to be longer. The amount of displacement at the free ends of the moving contact members 852, 853 is very large from the position shown in the figure to the position at which the memory card has been inserted as far as possible. As a result, the lengths of the moving contact members 852, 853 have to be longer and the amount of displacement per unit length has to be increased in order to prevent permanent deformation of the moving contact members 852, 853 even when the free ends are displaced by a large amount.

The purpose of the Present Application is to solve the problem associated with conventional card connectors by providing a reliable card connector with a simple configuration that is easy to manufacture and does not increase the number of components yet is able to reliably detect a card without malfunctioning, reducing manufacturing costs and improving reliability. This is done by having the moving portion of at least the first contact member or the second contact member, which function as the detection switch by separating to detect a card, unevenly mate with the housing.

The Present Application is a connector having a housing for housing a card equipped with a terminal member, a connection terminal attached to the housing for contacting the terminal member of the card and a detecting switch equipped with a first contact member and a second contact member for detecting separation therefrom and the insertion of a card into the housing, wherein at least the contact members are equipped with a fixed portion fixed to the housing and a moving portion displaceable by the housing and unevenly mated with the housing.

In yet another connector, the fixed portion is fixed to the wall portion of the housing, and the moving portion is displaceable in the direction perpendicular to the surface of the wall portion and is displaced in the direction of the wall portion when a card is inserted into the housing. In yet another connector, one of either the moving portion or the wall portion is equipped with a mating protrusion portion and the other is equipped with a mating recessed portion for mating with the mating protrusion portion.

In yet another connector, the connector is further equipped with a sliding member for holding the card inserted into the housing and sliding, a biasing member for biasing the sliding member in the opposite direction of the card insertion direction, and a card guiding mechanism for moving the card in the opposite direction of the insertion direction from the overstroke position and discharging the card when the card is held in the lock position. Contact is maintained between the terminal member of the card and the connection terminal, and the push operation pushing the card held in the lock position in the insertion direction causes the card to move in the insertion direction as far as the overstroke position, wherein the moving portion is unevenly mated with the housing when the card is at least between the lock position and the overstroke position. In yet another connector, the connector is further equipped with a cover member attached to the housing for covering at least the portion of the card inserted into the housing, and the moving portion is unevenly mated with the housing to at least stop displacement towards the cover member.

In yet another connector, the first contact member is equipped with a fixed portion and a moving portion. The moving portion is equipped with a cantilevered main body portion connected at the base end to the fixed portion, a contact portion connected to the free end of the main body portion and able to contact the second contact member, and a card abutting portion and abutting the card inserted into the housing. Finally, in yet another connector, the moving portion of at least the first contact member or the second contact member, which function as the detection switch by separating to detect a card, unevenly mates with the housing. As a result, the Present Application is able to provide a reliable card connector with a simple configuration that is easy to manufacture and does not increase the number of components yet is able to reliably detect a card without malfunctioning, reduce manufacturing costs and improve reliability.

BRIEF DESCRIPTION OF THE FIGURES

The organization and manner of the structure and operation of the Present Application, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Application may be susceptible to embodiment in different forms, there is shown in the Figures, and will be described herein in detail, specific embodiments, with the understanding that the disclosure is to be considered an exemplification of the principles of the Present Application, and is not intended to limit the Present Application to that as illustrated.

In the illustrated embodiments, directional representations—i.e., up, down, left, right, front, rear and the like, used for explaining the structure and movement of the various elements of the Present Application, are relative. These representations are appropriate when the elements are in the position shown in the Figures. If the description of the position of the elements changes, however, it is assumed that these representations are to be changed accordingly.

Figure 1:
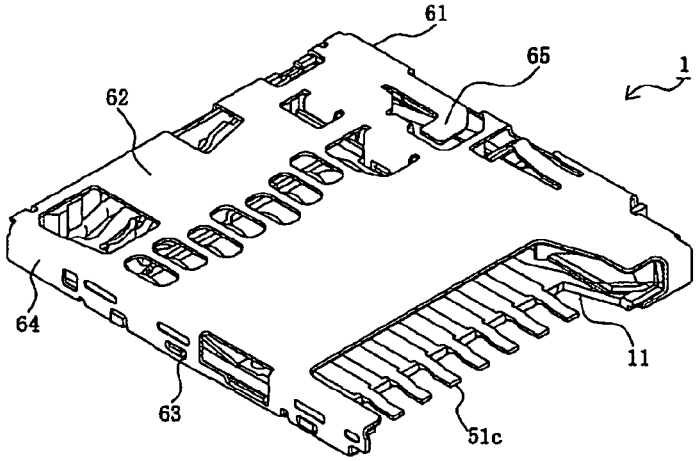
FIG. 1 is a perspective view of a connector for a memory card in accordance with the Present Application with (a) the shell installed and (b) the shell removed.
Figure 1:
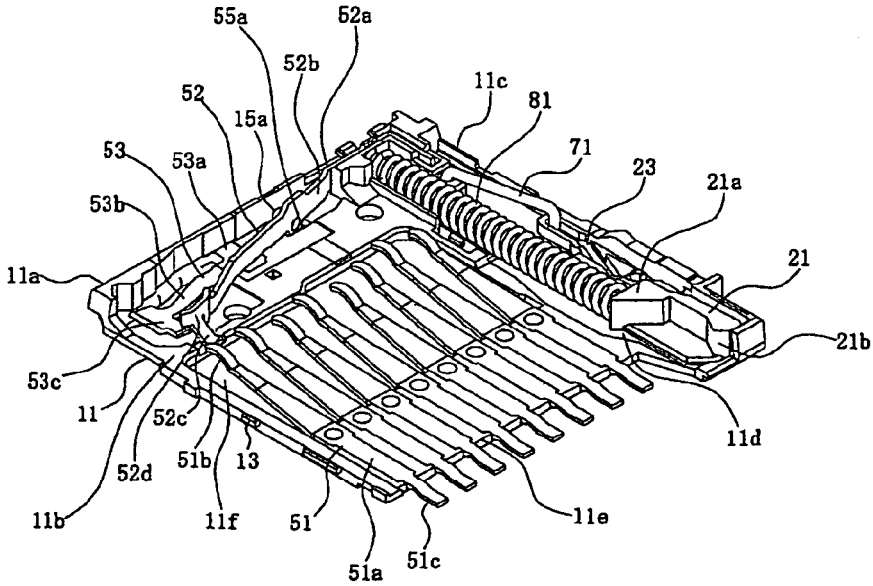

Referring to FIG. 1, 1 is a card connector according to the Present Application, mounted in an electronic device (not shown). The card 101 described below is inserted into the card connector 1, and the card 101 is attached to the electronic device via the card connector 1. The card connector 1 has a housing 11 integrally molded from an insulating material, and a shell 61 integrally formed from a conductive material and serving as a cover member mounted on the upper side of the housing 11. The shell 61 covers the housing 11 and at least a portion of the upper surface of the card 101 being housed; The card connector 1 has a somewhat flat three-dimensional shape. Finally, the card 101 is inserted from the front (from the lower right in FIG. 1).

As shown in FIG. 1, the housing 11 has a bottom wall portion 11*b* in which the front edge side (upper left side in FIG. 1), front relative to the insertion direction for the card 101, has a U-shape, and an inner wall portion 11*a* extending along the inside edge (the lower right edge in FIG. 1) to the inside of the bottom wall portion 11*b* and rising from the bottom wall 11*b*. The bottom wall portion 11*b* is equipped with a terminal holding portion 11*e* having terminals 51 mounted in the upper surface. A plurality of terminal mounting grooves is formed on the upper surface of the terminal holding portion 11*e* so as to extend in the forward direction (in the direction from the upper left to the lower right in FIG. 1), and the terminals 51 are inserted and mounted in these terminal mounting grooves. The base portion 51*a* of the terminals 51 is mounted in the terminal mounting grooves, and the end portion 51*b* extends obliquely towards the inner wall portion 11*a* and protrudes upward from the upper surface of the bottom wall portion 11*b*. The end portion 51*b* of the terminals 51 contacts the contact pad arranged on the bottom surface of the card 101 and establishes an electrical connection. The solder tail portion 51*c* extending from the base portion of the terminals 51 extends forward from the front edge of the bottom wall portion 11*b*, and establishes an electrical connection with the terminals on the other end, such as signal wires, contact pads or terminals formed on a printed circuit board in the electronic device.

An opening 11*f* is formed in the portion corresponding to the end portion 51*b* of the terminals 51 on the bottom wall portion 11*b*. This opening passes through the bottom wall portion 11*b* in the thickness direction. This opening 11*f* can be omitted if necessary.

The housing 11 has a side wall portion 11*c* which has an L-shaped cross-section and extends longitudinally along one side edge of the bottom wall portion 11*b*. A card guiding mechanism housing portion 11*d* is formed on the inside of the side wall portion 11*c*, and the sliding member 21 of the card guiding mechanism for guiding the card 101 inserted into the card connector 1 is mounted slidably in the longitudinal direction in the card guiding mechanism housing portion 11*d*. The sliding member 21 is integrally molded from an insulating material.

The sliding member 21 is equipped with a first engaging portion 21*a* and a second engaging portion 21*b* formed so as to protrude from the side surface on the inside. The engaging portions 21*a*, 21*b* engage the engaging portion with an uneven surface formed on the side surface of the card 101. The sliding member 21 holds the card 101 with the first engaging portion 21*a* and the second engaging portion 21*b* and moves longitudinally with the card 101.

One end of the coil spring biasing member 81 engages the sliding member 21 to provide biasing force when compressed. The other end of the biasing member 81 engages the inner wall portion 11*a*. In this way, the sliding member 21 is biased in the opposite direction of the insertion direction of the card 101. In other words, it is biased in the discharge direction of the card 101.

The card connector 1 has to function so as to push in the card 101 when the card 101 is inserted into the card connector 1 and when the card 101 is removed from the card connector 1. In other words, it has to have a push-in/push-out configuration or a push/push configuration. This operation is similar to the alternating operation of a push button (position-holding type or push-on/push-off type). The cam groove 23 formed in the upper surface of the sliding member 21 functions as the sliding cam in a heart-shaped cam mechanism is used to perform this operation.

The free end of the slender pin member 71, as a fixed cam member, engages the cam groove 23. The other end of the pin member 71 is fixed, engages the upper surface of the inner wall portion 11*a* inside the card guiding mechanism housing portion 11*d* of the housing 11, and is pivot joined. The pin member 71 and the cam groove 23 move together to perform the push/push operation on the sliding member 21 moving with the card 101. When the card guiding mechanism has moved the card 101 in the insertion direction as far as possible, the biasing action of the biasing member 81 moves the card 101 in the opposite direction and ejects the card.

The pin member 71 is biased downward by the pin pressing member 65 on the shell 61 and held in place. The pin pressing member 65 is a sheet with spring action, bent so as to compress a portion of the shell 61 in the direction of the bottom wall portion 11*b* of the housing 11. The pin member 71 is positioned between the pin pressing member 65 and the sliding member 21 or the housing 11, held so as not to become detached from the sliding member 21 or the housing 11.

The shell 61 has a wedge-shaped ceiling sheet portion 62 and a plurality of side sheet portions 64 standing erect from a plurality of locations along the side edge of the ceiling sheet portion 62. A plurality of engagement openings 63 are formed in the side sheet portion 64. As shown in FIG. 1(*a*), when the shell 61 is attached to the upper end of the housing 11, the engagement holes 63 engage the engagement protrusions 13 formed on the outer surface of the side wall portion 11*c* of the housing 11. This secures the shell 61 to the housing 11. A portion of the bottom end of the shell 61 can be connected electrically to a ground. In this way, the shell 61 can function as an electromagnetic shielding member.

Contact between the contact pad of the card 101 and the terminals 51 is detected, and the installation of the card 101 in the card connector 1 is detected by a card detection switch arranged on the inside of the housing 11. This card detection switch consists of a first contact member 52 and a second contact member 53 mounted on and near the inner wall portion 11*a*. The first contact member 52 has a mounting portion 52*a* mounted on the inner wall portion 11*a*, a cantilevered main body portion 52*b* whose base end is connected to the mounting portion 52*a* and which extends laterally or in the widthwise direction of the housing 11, a contact portion 52*c* connected to the free end of the main body portion 52*b*, and a card abutting portion 52*d*. The mounting portion 52*a* fixed to the housing 11, and the main body portion 52*b*, the contact portion 52*c* and the card abutting portion 52*d* are able to be displaced with respect to the housing 11. The contact portion 52*c* is connected to the bottom end of the card abutting portion 52*d*. The mounting portion 52*a* is substantially parallel to the side surface of the inner wall portion 11*a*, the main body portion 52*b* is oblique relative to the side surface of the inner wall portion 11*a* when a card 101 has not been inserted into the card connector 1, and the contact portion 52*c* and the card abutting portion 52*d* extend forward with respect to the insertion direction of the card 101. As a result, when a card 101 is inserted, the front end of the card 101 comes into contact with the card abutting portion 52*d*.

The second contact member 53 has a mounting portion 53*a* mounted on the inner wall portion 11*a* near the lower wall portion 11*b*, a cantilevered main body portion 53*b* whose base end is connected to the mounting portion 53*a* and which extends in the direction of the side wall portion 11*c*, and a contact portion 53*c* connected to the free end of the main body portion 53*b*. The mounting portion 53*a* is fixed to the housing 11, and the main body portion 53*b* and the contact portion 53*c* are able to be displaced with respect to the housing 11. The second contact member 53 is arranged below the first contact member 52, towards the inner wall portion 11*a*.

As the contact members 52, 53 do not make contact when a card 101 has not been inserted, the card detection switch is usually not electrified and is turned off. However, when a card 101 has been inserted and reaches the position where the contact pad on the card establishes contact with the terminals 51, the card abutting portion 52*d* of the first contact member 52 is displaced by the front end of the card 101 and pushed in the direction of the inner wall portion 11*a*. The contact portion 52*c* makes contact with the contact portion 53*c* of the second contact member 53. The contact members 52, 53 make contact, and the card detection switch is electrified and is turned on. The contact members 52, 53, as shown in FIG. 1(*a*), are arranged so as not to make contact with the shell 61, even when the shell 61 is mounted on the upper side of the housing 11. In this embodiment, either of the contact members 52, 53, functioning as the card detection switch, unevenly mates with the housing 11 in the moving portions. Because this prevents displacement of the moving portions to the outside, the contact members 52, 53 do not become entangled or make contact with the shell 61, even when the card connector 1 is subject to impact or vibration.

In the example shown in FIG. 1, a mating hole 55*a* passing through the main body portion 52*d* in the thickness direction is formed in the main body portion 52*b* of the first contact member 52 as the contact member side mating portion. The mating protrusion 15*a*, extending forward with respect to the insertion direction of the card 101, is formed integrally with the inner wall portion 11*a*. The mating protrusion 15*a* is inserted into the mating hole 55*a* in the first contact member 52. In other words, the mating hole 55*a* is formed in the first contact member 52 as a mating recessed portion, the mating protrusion 15*a* is formed in the housing 11 as the mating protrusion portion, and the moving portion of the first contact member 52 unevenly mates with the housing 11.

Figure 2:
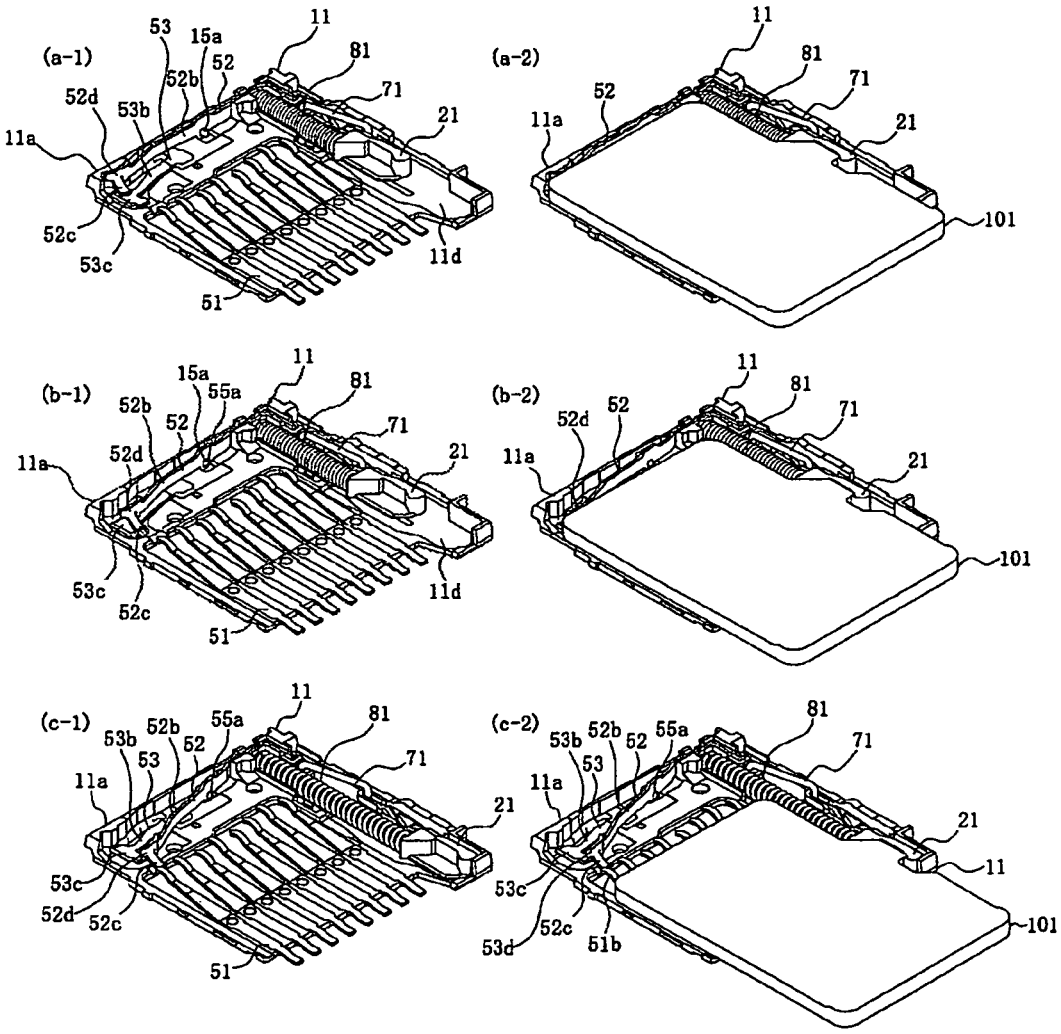
FIG. 2 is a perspective view showing a series of uneven mating operations performed by the first contact member and the housing in accordance with the Present Application at (a) the overstroke position, (b) the lock position and (c) the temporary card holding position with (−1) showing the shell and card removed and (−2) showing the shell removed.
Figure 3:
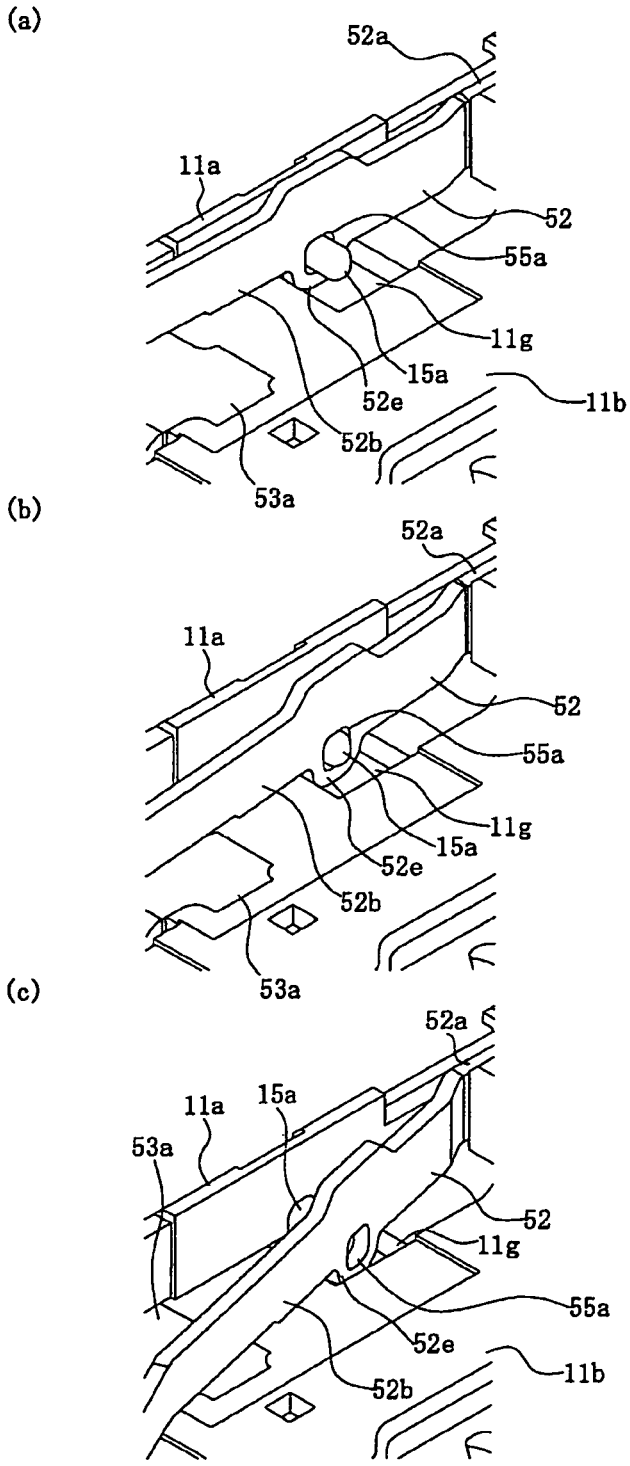
FIG. 3 is an enlarged view of the series of uneven mating operations of FIG. 2.

Referring to FIGS. 2-3, when a card 101 is inserted into the front of the card connector 1, the front end of the card 101 is facing the inner wall portion 11*a* of the housing 11, the surface with the contact pads faces the bottom wall portion 11*b*, and the surface without the contact pads faces the ceiling sheet portion 62 of the shell 61. As the card 101 advances, the side surface with the protruding and recessed portion moves along the side wall portion 11*c* of the housing 11.

Next, when the card 101 is pushed, the card 101 passes the temporary card holding position as shown in FIG. 2(*c*-1). The temporary card holding position is disposed where the sliding member 21 is stopped when the card 101 is ejected from the card connector 1. While the engaging portions 21*a*, 21*b* of the sliding member 21 gently engages the engaging portion of the card 101 and the card 101 is held by the sliding member 21, if the card 101 is pulled out manually, the hold of the sliding member 21 is released even though strong tensile force is applied.

At the temporary card holding position, the contact pad on the card 101 is not in contact with the end portion 51*b* of the terminals 51, and the front end of the card 101 is not in contact with the card abutting portion 52*d* of the first contact member 52. As a result, the card detection switch in the initial state is not electrified and is turned off.

Because in the initial state the main body portion 52*b* of the first contact member 52 is far apart and oblique with respect to the side surface of the inner wall portion 11*a*, the mating protrusion 15*a* is not inserted into the mating hole 55*a* as shown in FIG. 3(*c*). As a result, the first contact member 52 can be easily mounted in the housing 11, the assembly time for the card connector 1 can be reduced, and manufacturing costs can be held down. Because the first contact member 52 moves from above with respect to the housing 11 and the mounting portion 52*a* is pushed into the groove in the inner wall portion 11*a* from above when the first contact member 52 is mounted in the housing 11, the protruding amount of the mating protrusion 15*a* is small yet is not inserted into the mating hole 55*a* initially. Thus, the first contact member 52 moves smoothly.

However, the mating protrusion 15*a* can be designed to enter the mating hole 55*a* in the initial state. This keeps the first contact member 52 from being displaced to the outside even when the card connector 1 is subjected to impacts and vibrations without a card 101 being inserted.

In order to form the mating hole 55*a*, the protruding portion 52*e* is formed integrally in the main body portion 52*b* of the first contact member 52 while protruding downward. In order to house the protruding portion 52*e*, the recessed portion 11*g* is formed in the bottom wall portion 11*b* of the housing 11. By forming a protruding portion 52*e* and a recessed portion 11*g*, the strength of the first contact member 52 is maintained and the card connector 1 can have a lower profile. The recessed portion 11*g* can be omitted if necessary.

When the card 101 is pushed in further, the card 101 moves toward the inner wall portion 11*a* along with the sliding member 21, and passes the lock position as shown in FIG. 2(*b*-2). At this time, the force exerted on the card 101 is transmitted from the engaging portion of the card 101 to the sliding member 21 via the first engaging portion 21*a*. Because the sliding member 21 compresses the coil spring serving as the biasing member 81, the sliding member 21 and the card 101 are subjected to the rebound of the biasing member 81. However, because this rebound is smaller than the force exerted on the card 101, it is resisted by the movement.

As it moves from the temporary card holding position to the lock position, the contact pad on the card 101 contacts the end portion 51*b* of the terminals 51. The front surface of the card 101 in the insertion direction contacts the card abutting portion 52*d* of the first contact member 52, and the card abutting portion 52*d* is displaced in the direction of the inner wall portion 11*a*. In this way, the contact portion 52*c* of the first contact member 52 contacts the contact portion 53*c* of the second contact member 53, and the card detection switch is electrified and turned on.

In the lock position, the contact pad of the card 101 contacts the end portion 51*b* of the terminals 51, and the contact portion 52*c* of the first contact member 52 remains in contact with the contact portion 53*c* of the second contact member 53. Because the main body portion 52*b* of the first contact member 52 is near the side surface of the inner wall portion 11*a* in the lock position, the mating protrusion 15*a* is inserted into the mating hole 55*a*, as shown in FIG. 3(*b*). Because the moving portions of the first contact member 52 are kept from being displaced outside the displacement direction (the insertion direction of the card 101), the contact members 52, 53 do not become entangled or make contact with the shell 61, even when the card connector 1 is subjected to vibrations and impacts. In this embodiment, the moving portions of the second contact member 53 does not unevenly engage the housing 11. Because the length of the main body portion 53*b* of the second contact member 53 is relatively small, the moving portions of the second contact member 53 are not displaced much outside of the displacement direction (perpendicular to the bottom wall portion 11*b*) even when the card connector 1 is subject to vibrations and impacts.

Next, when the card 101 is pushed in further, the card 101 moves towards the inner wall portion 11*a* along with the sliding member 21 and, as shown in FIG. 2(*a*-2) reaches the overstroke position and the overstroke state. In the overstroke position, the contact pad of the card 101 remains in contact with the end portion 51*b* of the terminals 51 and the contact portion 52*c* of the first contact member 52 remains in contact with the contact portion 53*c* of the second contact member 53. Also, in the overstroke position, the main body portion 52*b* of the first contact member 52 approaches the side surface of the inner wall portion 11*a*. Thus, as shown in FIG. 3(*a*), the mating protrusion 15*a* enters the mating hole 55*a*. Because the moving portions of the first contact member 52 are kept from being displaced outside of the displacement direction, the first contact member 52 and the second contact member 53 do not become entangled or make contact with the shell 61, even when the card connector 1 is subjected to vibrations and impacts.

When the pushing of the card 101 stops, and the force exerted on the card 101 is released, the rebound force of the biasing member 81 moves the sliding member 21 and the card 101 away from the inner wall portion 11*a*. Then, the sliding member 21 and the card 101 are stopped at the lock position where the card 101 is locked inside the card connector 1. The free end of the pin member 71 engaging the cam groove 23 formed in the upper surface of the sliding member 21 catches a portion of the cam groove 23 and stops the movement of the sliding member 21. This stops the sliding member 21 in the lock position.

When the card 101 is held in the lock position, data is exchanged with the operating means in the electronic device via the board mounted in the card connector 1. When the card 101 is held in the lock position, the contact pad on the card 101 contacts the end portion 51*b* of the terminals 51. As shown in FIG. 2(*b*-1), the contact portion 52*c* of the first contact member 52 remains in contact with the contact portion 53*c* of the second contact member 53, and the card detection switch is turned on. Because the mating protrusion 15*a* is inserted into the mating hole 55*a* when the card 101 is at least between the lock position and the overstroke position, the first contact member 52 and the second contact member 53 do not become entangled or make contact with the shell 61. When the card 101 is ejected from the card connector 1, the card 101 is manually pushed in. The sliding member 21 and the card 101 move from the lock position towards the inner wall portion 11*a*, and reaches the overstroke position and the overstroke state.

When the pushing of the card 101 stops, and the force exerted on the card 101 is released, the rebound force of the biasing member 81 moves the sliding member 21 and the card 101 in the overstroke position away from the inner wall portion 11*a* in the opposite direction of the insertion direction. The sliding member 21 and the card 101 are moved by the spring action of the biasing member 81 past the lock position in the opposite direction of the insertion direction of the card 101. Because the rest of the ejection operations performed on the card 101 are the opposite of the insertion operations performed on the card 101, further explanation has been omitted.

In this embodiment, the card detection switch is electrified and turned on when the card 101 is inserted and the first contact member 52 contacts the second contact member 53. However, the card detection switch can be de-electrified and turned on when the card 101 is inserted and the first contact member 52 is separated from the second contact member 53. In this card detection switch, when the card 101 is inserted, there is a change from the initial electrified state and the insertion of a card 101 into the housing 11 is detected. Further, the first contact member 52 and the second contact member 53 are arranged on the inside of the housing 11, and the first contact member 52 is displaced by the front end of the card 101. However, the first contact member 52 and the second contact member 53 can be arranged on the inner edge of the housing 11 and the first contact member 52 can be displaced by the side edge of the card 101.

The card connector 1 has a housing 11 for accommodating a card 101 with terminal members, terminals 51 contacting the terminal members of the card 101, and a card detecting switch consisting of a first contact member 52 and a second contact member 53 which are separated to detect the insertion of a card 101 into the housing 11. At least the first contact member 52 or the second contact member 53 is equipped with a fixed portion fixed to the housing 11 and a movable portion displaceable with respect to the housing 11 and unevenly mated with the housing 11. This allows the first contact member 52 to engage the second contact member 53 even when the card connector 1 is subjected to vibrations and impacts. This also provides a simple configuration that is easy to manufacture and does not increase the number of components yet is able to reliably detect a card 101 without malfunctioning, reducing manufacturing costs and improving reliability. Also, the moving portions unevenly mate with the housing 11 when the card 101 is at least between the lock position and the overstroke position. As a result, the first contact member 52 can reliably engage the second contact member 53 when a card 101 is accommodated inside the housing 11, even when the card connector 1 is subjected to vibrations and impacts.

Figure 4:
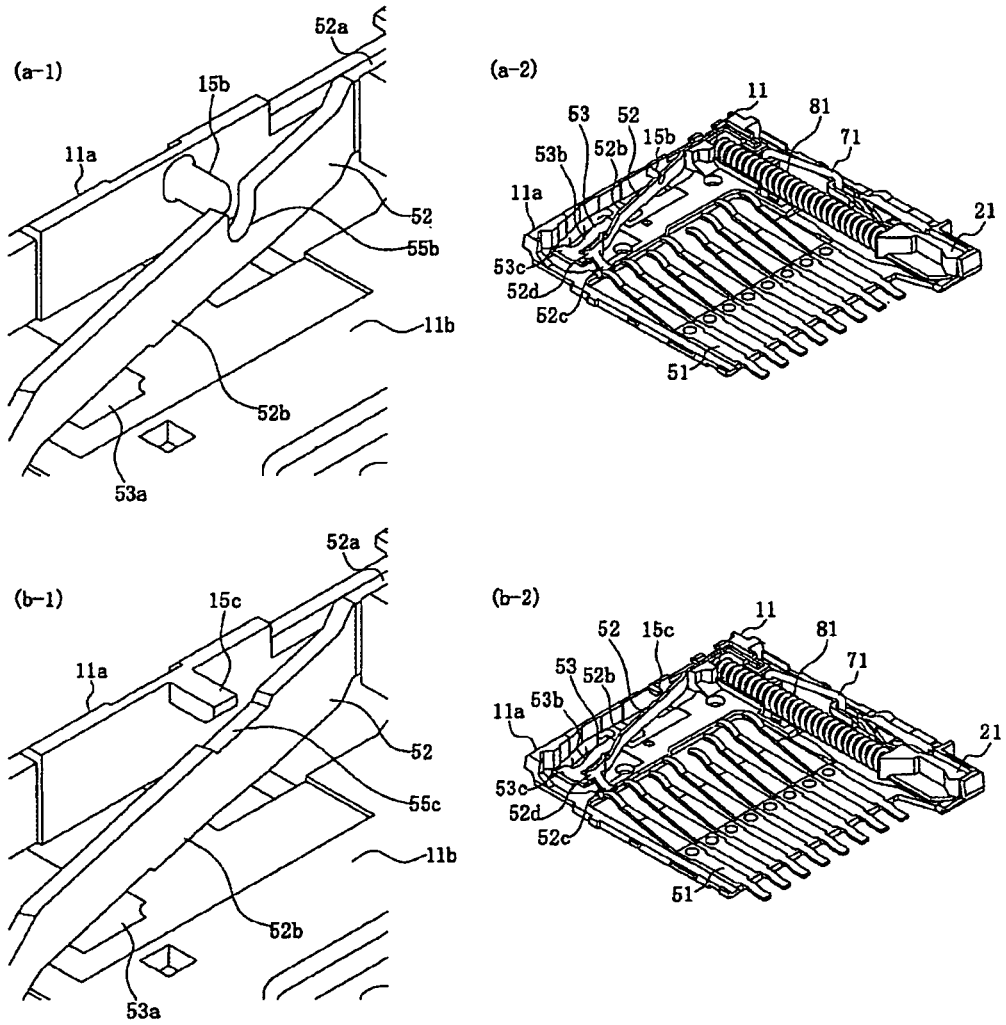
FIG. 4 is a perspective view of an uneven mating structure between the first contact member and the housing in accordance with the Present Application which (a) shows one embodiment, (b) shows another embodiment, (−1) is an enlarged view, and (−2) is an overall view.

In an alternative embodiment, as shown in FIG. 4(*a*), a U-shaped notch 55*b* passing through the main body portion 52*b* in the thickness direction and opening into the upper end edge of the main body portion 52*b* is formed in the main body portion 52*b* of the first contact member 52 as the mating recessed portion or the mating portion on the contact member side. A mating protrusion 15*b* is formed integrally in the inner wall portion 11*a* in the position corresponding to the notch 55*b* and extending forward with respect to the insertion direction of the card 101 as the mating protrusion portion or the mating portion on the housing side. The mating protrusion 15*b* enters the notch 55*b* in the first contact member 52.

Because a mating hole 55*a* does not have to be formed in an alternative embodiment, there is no protruding portion 52*e* on the main body portion 52*b* of the first contact member 52. As a result, the bottom end of the main body portion 52*b* has a smooth, linear shape and the overall shape of the main body portion is simple. Therefore, the manufacturing costs of the first contact member 52 can be reduced. Also, a recessed portion 11*g* for housing the protruding portion 52*e* does not have to be formed in the bottom wall portion 11*b* of the housing 11. Therefore, the shape of the bottom wall portion 11*b* of the housing 11 can be simplified and the manufacturing costs of the housing 11 can be reduced.

Because the upper end of the notch 55*b* is open in an alternative embodiment, the moving portions of the first contact member 52 is displaced downward (in the direction approaching the bottom wall portion 11*b*) even when the mating protrusion 11*b* has entered the notch 55*b*. However, because the moving portions of the first contact member 52 are kept from being displaced upward (in the direction approaching the shell 61), the amplitude is suppressed even when the moving portions of the first contact member 52 vibrate vertically. As a result, the first contact member 52 and the second contact member 53 are kept from becoming entangled to a significant degree. Also, the first contact member 52 and the second contact member 53 are reliably kept from making contact with the shell 61.

The rest of the configuration and operations of this embodiment are the same as those of the previous embodiment, so further explanation has been omitted.

In another alternative embodiment, as shown in FIG. 4(*b*), a shallow rectangular notch 55*c* passing through the main body portion 52*b* in the thickness direction and opening to the upper end edge of the main body portion 52*b* is formed in the main body portion 52*b* of the first contact member 52 as the mating recessed portion or mating portion on the contact member side. The mating protrusion 15*c* is integrally formed on the inner wall portion 11*a* in the position corresponding to the notch 55*c* and extending forward with respect to the insertion direction of the card 101 to serve as the mating protruding portion or the mating portion on the housing side. The mating protrusion 15*c* is inserted into the notch 55*c* in the first contact member 52.

This embodiment differs from a previous embodiment in that the notch 55*c* has a shallow rectangular shape and in that the cross-sectional shape of the mating protrusion 15*c* is rectangular in order to correspond to the shape of the notch 55*c*. The rest of the configuration and operations are the same as those of a previous embodiment, so further explanation has been omitted.

In the previous embodiments of the Present Application, the moving portions are unevenly mated with the housing 11 which at least keeps the moving portions from being displaced in the direction approaching the shell 61. As a result, the first contact member 52 and the second contact member 53 can be reliably kept from making contact with the shell 61.

Figure 5:
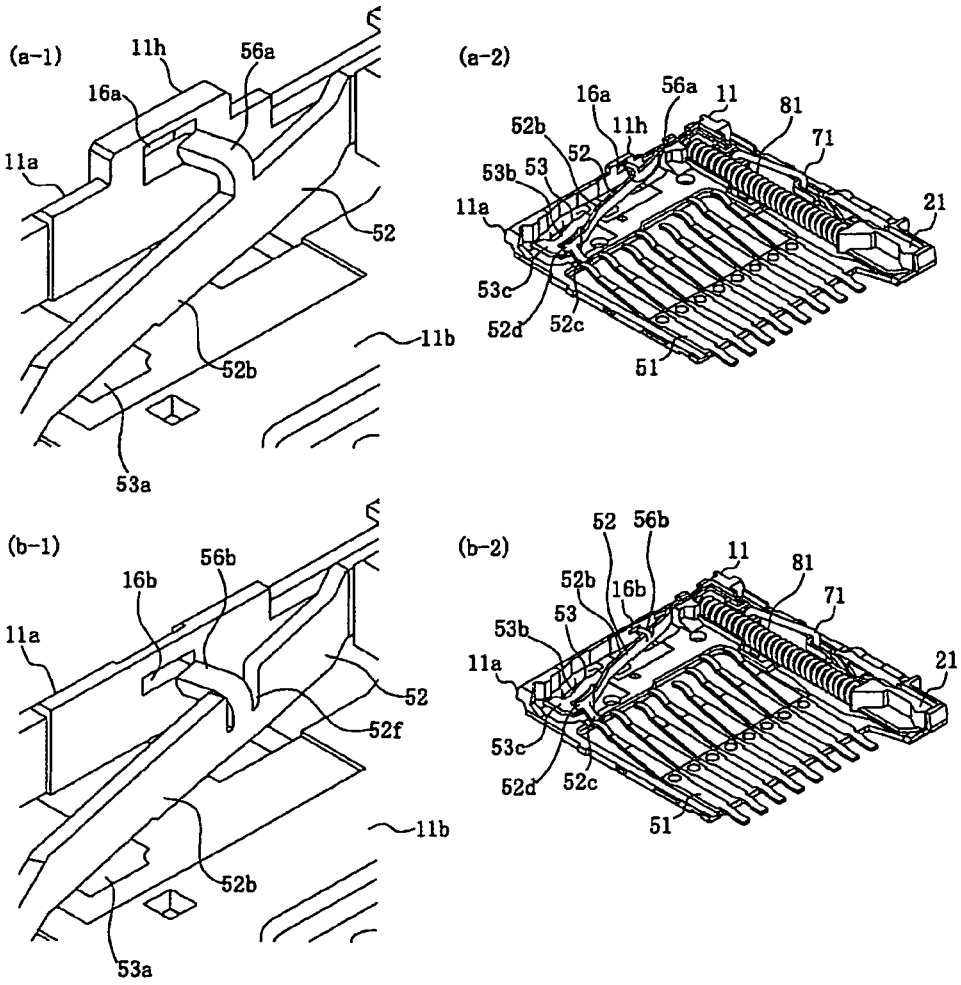
FIG. 5 is a perspective view of an uneven mating structure between the first contact member and the housing in accordance with the Present Application which (a) shows one embodiment, (b) shows another embodiment, (−1) is an enlarged view, and (−2) is an overall view.

In further alternative embodiments, a mating protruding portion is formed in the main body portion 52*b* of the first contact member 52 as the mating portion on the contact member side and a mating recessed portion is formed in the inner wall portion 11*a* as the mating portion on the housing side. As shown in FIG. 5(*a*), the mating protrusion 56*a* serving as the mating protruding portion is integrally connected to the upper end edge of the main body portion 52*b* of the first contact member 52. The mating protrusion 56*a* is bent near the base end connected to the upper end edge of the main body portion 52*b*, and the end is formed towards the inner wall portion 11*a* perpendicular to the surface of the main body portion 52*b*. Therefore, the mating protrusion 56*a* protrudes upward from the upper end edge of the main body portion 52*b*.

The mating hole 16*a* serving as the mating recessed portion is formed in the inner wall portion 11*a* so as to pass through the inner wall portion 11*a* in the thickness direction in the position corresponding to the mating protrusion 56*a*. Because a mating hole 16*a* is formed, a protruding portion 11*h* extending upward is integrally formed in the inner wall portion 11*a*. The mating protrusion 56*a* in the first contact member 52 is inserted into the mating hole 16*a* in the inner wall portion 11*a*.

Because this keeps the moving portions of the first contact member 52 from being displaced in a direction other than the direction of displacement, the first contact member 52 and the second contact member 53 are kept from becoming entangled and from making contact with the shell 61, even when the card connector 1 is subjected to vibrations and impacts.

The rest of the configuration and operations of this embodiment are the same as those of a previous embodiment, so further explanation has been omitted.

In another alternative embodiment, as shown in FIG. 5(*b*), a notch 52*f* extending downward from the upper end edge is formed in the main body portion 52*b* of the first contact member 52, and a mating protrusion 56*b* is integrally formed as the mating protruding portion halfway vertically in the main body portion 52*b* near the lower end portion of the notch 52*f*. The mating protrusion 56*a* is bent near the base end connected to the main body portion 52*b*, and the end is formed towards the inner wall portion 11*a* perpendicular to the surface of the main body portion 52*b*. Therefore, the mating protrusion 56*a* does not protrude upward from the upper end edge of the main body portion 52*b*.

The mating hole 16*a* serving as the mating recessed portion is formed in the inner wall portion 11*a* so as to pass through the inner wall portion 11*a* in the thickness direction in the position corresponding to the mating protrusion 56*a*. Because the mating protrusion 56*b* does not protrude upward from the upper end edge of the main body portion 52*b*, the mating hole 16*b* can be formed even when a protruding portion 11*h* extending upward is not formed. Because a protruding portion 11*h* does not have to be formed, the shape of the inner wall portion 11*a* can be simplified, and the manufacturing costs for the housing 11 can be reduced. The profile of the inner wall portion 11*a* can also be lowered. As a result, the profile of the housing 11 can be lowered, and the overall profile of the card connector 1 can be lowered.

The rest of the configuration and operations of this embodiment are the same as those of a previous embodiment, so further explanation has been omitted.

Figure 6:
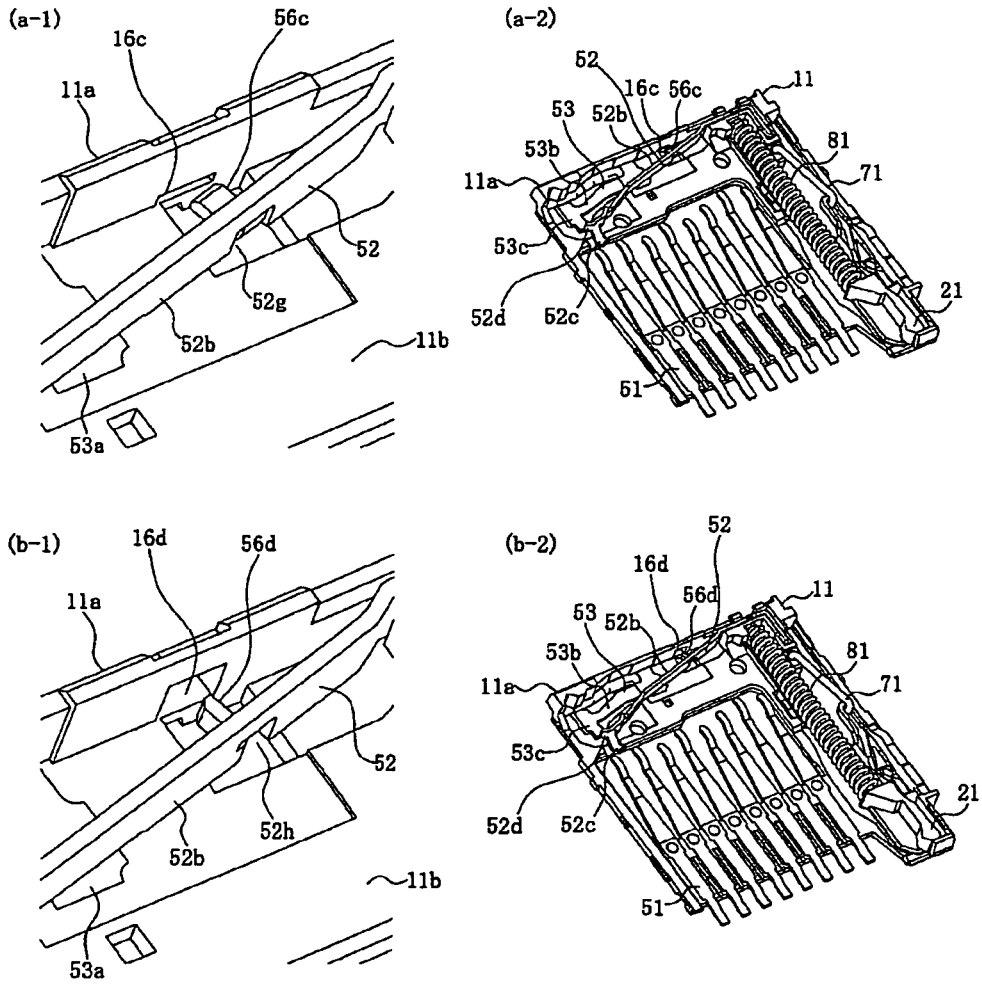
FIG. 6 is a perspective view of an uneven mating structure between the first contact member and the housing in accordance with the Present Application which (a) shows one embodiment, (b) shows another embodiment, (−1) is an enlarged view, and (−2) is an overall view.

In a further alternative embodiment, as shown in FIG. 6(*a*), a notch 52*g* extending downward from the lower end edge is formed in the main body portion 52*b* of the first contact member 52, and a mating protrusion 56*b* is integrally formed as the mating protruding portion halfway vertically in the main body portion 52*b* near the upper end portion of the notch 52*g*. The mating protrusion 56*c* is bent near the base end connected to the main body portion 52*b*, and the end is formed towards the inner wall portion 11*a* perpendicular to the surface of the main body portion 52*b*. Therefore, the mating protrusion 56*c* does not protrude downward from the lower end edge of the main body portion 52*b*. The mating hole 16*c* serving as the mating recessed portion is formed in the inner wall portion 11*a* so as to pass through the inner wall portion 11*a* in the thickness direction in the position corresponding to the mating protrusion 56*c*.

This embodiment differs from a previous embodiment in that the positioning of the notch 52*g*, the mating protrusion 56*c* and the mating hole 16*c* is reversed vertically with respect to the positioning of the notch 52*f*, the mating protrusion 56*b* and the mating hole 16*b*. The rest of the configuration and operations are the same as those of a previous embodiment, so further explanation has been omitted.

In a further alternative embodiment, as shown in FIG. 6(*b*), a notch 52*h* extending downward from the lower end edge is formed in the main body portion 52*b* of the first contact member 52, and a mating protrusion 56*d* serving as the mating protruding portion is connected integrally to the main body portion 52*b* in the free end portion of the notch 52*h*. The mating protrusion 56*d* is bent near the base end connected to the main body portion 52*b*, and the end is formed towards the inner wall portion 11*a* perpendicular to the surface of the main body portion 52*b*. Therefore, the mating protrusion 56*d* does not protrude downward from the lower end edge of the main body portion 52*b*. The mating hole 16*d* serving as the mating recessed portion is formed in the inner wall portion 11*a* so as to pass through the inner wall portion 11*a* in the thickness direction in the position corresponding to the mating protrusion 56*d*.

This embodiment differs from a previous embodiment in that the shape of the notch 52*h*, the mating protrusion 56*d* and the mating hole 16*d* differ from the shape of the notch 52*g*, the mating protrusion 56*c* and the mating hole 16*c*. The rest of the configuration and operations are the same as those of a previous embodiment, so further explanation has been omitted.

Figure 7:
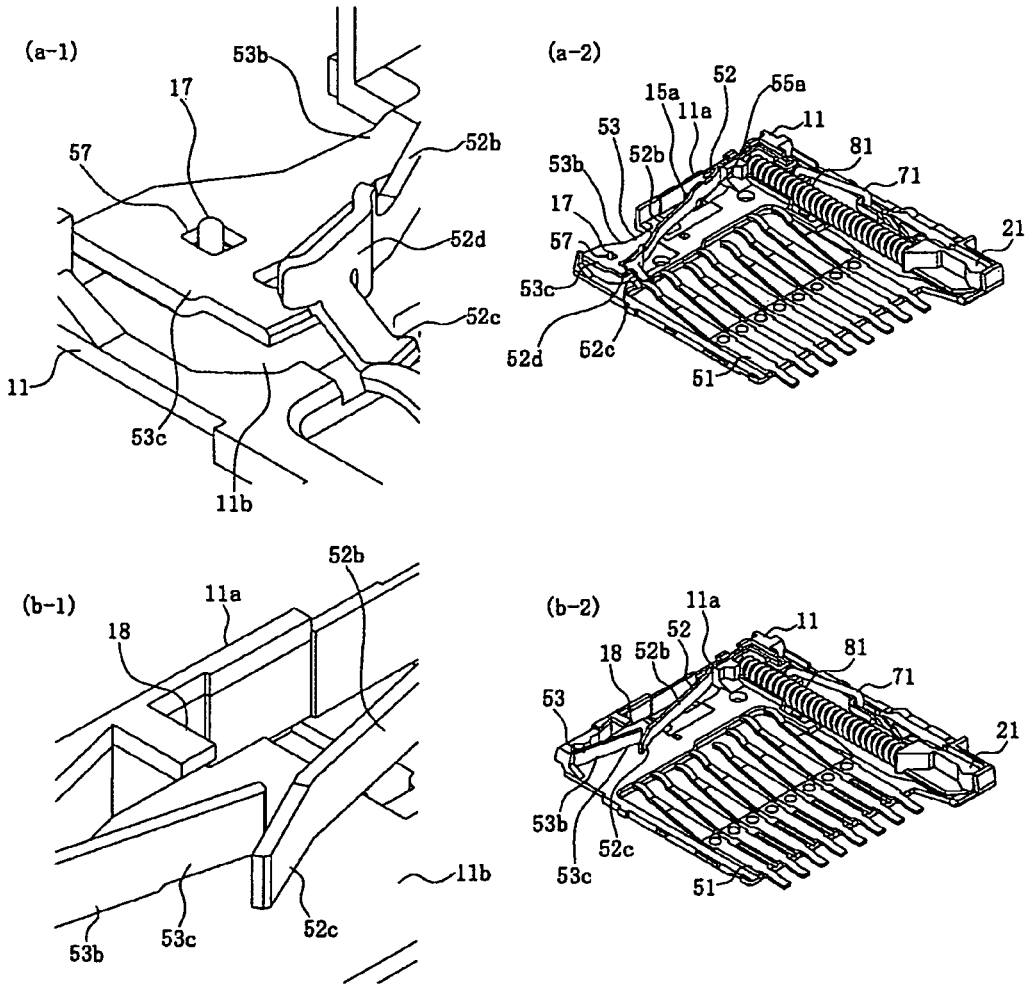
FIG. 7 is a perspective view of the uneven mating structure between the contact members in accordance with the Present Application which (a) shows one embodiment, (b) shows another embodiment, (−1) is an enlarged view, and (−2) is an overall view.
Figure 8:
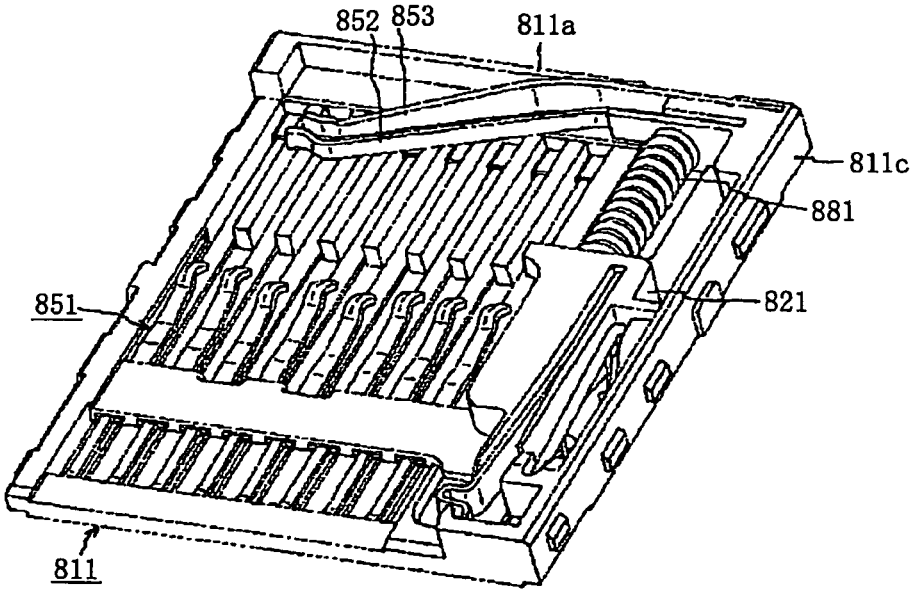
Prior Art FIG. 8
FIG. 8 is a perspective view of a conventional card connector.

In a further alternative embodiment, as shown in FIG. 7(*a*), both the first contact member 52 and the second contact member 53 have moving portions that are unevenly mated with the housing 11. Because this keeps the moving portions of both the first contact member 52 and the second contact member 53 from being displaced in a direction other than the displacement direction, the first contact member 52 and the second contact member 53 are reliably kept from becoming entangled with each other and from making contact with the shell 61 even when the card connector 1 is subjected to vibrations and impacts.

In the example shown in FIG. 7(*a*), a mating hole 55*a* similar to the one in the first embodiment is formed in the first contact member 52, and a mating protrusion 15*a* similar to the one in the first embodiment is formed in the housing 11. The moving parts of the first contact member 52 are unevenly mated with the housing 11. Because configuration and operation of the moving portions of the first contact member 52 unevenly mated with the housing 11 are similar to the first embodiment, further explanation is omitted.

A mating hole 57 is formed as the mating portion on the contact member side in the connecting portion between the main body portion 53*b* and the contact portion 53*c* of the second contact member 53 so as to pass through the connecting portion in the thickness direction. A mating protrusion 17 is integrally formed as the mating portion on the housing side in the bottom wall portion 11*b* so as to protrude upward from the upper surface of the bottom wall portion 11*b*. The mating protrusion 17 is inserted into the mating hole 57 in the second contact member 53*a*. In other words, the mating hole 57 serving as the mating recessed portion is formed in the second contact member 53, the mating protrusion 17 serving as the mating protruding portion is formed in the housing 11, and the moving portions of the second contact member 53 are unevenly mated with the housing 11. Therefore, because the moving portions of the second contact member 53 are kept from being displaced in a direction other than the original displacement direction (the direction perpendicular to the bottom wall portion 11*b*), the first contact member 52 and the second contact member 53 are kept from becoming entangled with each other and from making contact with the shell 61, even when the card connector 1 is subjected to vibrations and impacts.

The rest of the configuration and operations of this embodiment are the same as those of a previous embodiment, so further explanation has been omitted.

In a further alternative embodiment, as shown in FIG. 7(*b*), the cantilevered main body portion 53*b* of the second contact member 53 is oblique with respect to the side surface of the inner wall portion 11*a* and is displaced in the insertion direction of the card 101 when a card 101 has not been inserted into the card connector 1. The main body portion 53*b* extends from the base end to the free end or from left to right in the figure, and the main body portion 52*b* of the first contact member 52 is opposed from the base end to the free end (from right to left in the figure). The contact portion 53*c* of the second contact member 53 is positioned-between the to contact portion 52*c* of the first contact member 52 and the inner wall portion 11*a*, and the mounting portion 53*a* of the second contact member 53 is fixed to the inner wall portion 11*a*.

The contact portion 52*c* of the first contact member 52 in this embodiment is nearly the same width as the main body portion 52*b*, and the main body portion 52*b* is formed with a slight curve near the free end. The first contact member 52 does not have a card abutting portion 52*d*, but the contact portion 52*c* functions as the card abutting portion 52*d*.

When a card 101 is not inserted, as shown in FIG. 7(*b*), the contact portion 52*c* of the first contact member 52 does not make contact with the contact portion 53*c* of the second contact member 53. However, when a card 101 is inserted reaches the position where the contact pad makes contact with the terminals 51, the contact portion 52*c* of the first contact member 52 is pushed by the front end of the card 101 and displaced in the direction of the inner wall portion 11*a*. The surface of the contact portion 52*c* on the inner wall portion 11*a* side also makes contact with the contact portion 53*c* of the second contact member 53. When the card 101 is pushed in further, the contact portion 53*c* of the second contact member 53 is pushed by the contact portion 52*c* of the first contact member 52, and rides up over the contact portion 52*c* of the first contact member 52 where it is pushed and displaced in the direction of the inner wall portion 11*a*.

A mating protrusion 18 is formed on the upper end of the inner wall portion 11*a* as the mating protrusion portion of the housing side mating portion, and extends towards the front relative to the insertion direction of the card 101. This mating protrusion is integrally formed in the position corresponding to the contact portion 52*c* of the first contact member 52 and the contact portion 53*c* of the second contact member 53. Pushed towards the inner wall portion 11*a* by the front end of the card 101 and displaced, the contact portion 52*c* of the first contact member 52 and the contact portion 53*c* of the second contact member 53 are inserted into the space below the mating protrusion 18. In other words, the upper end of the contact portion 52*c* of the first contact member 52 and the upper end of the contact portion 53*c* of the second contact member 53 function as the mating recessed portion. A mating protrusion 18 is also formed as a mating protrusion portion on the housing 11 to act as a moving portion allowing the first contact member 52 and the second contact member 53 to unevenly mate with the housing 11.

The rest of the configuration and operations of this embodiment are the same as those of a previous embodiment, so further explanation has been omitted.

While preferred embodiments of the Present Application are shown and described, it is envisioned that those skilled in the art may devise various modifications without departing from the spirit and scope of the foregoing Description and the appended Claims.

What is claimed is:

1. A connector for a card, the connector comprising: a housing, the housing being adapted to receive a card, the housing having an inner wall portion and a bottom wall portion, the card being equipped with a terminal member;

at least one connection terminal, the at least one terminal being attached to the bottom wall portion and contact the terminal member; and a detecting switch, the detecting switch including a first elongated contact member and a second elongated contact member, the contact members detecting both separation from each other and the insertion of the card into the housing, the first contact member disposed substantially parallel to the inner wall portion, the second contact member disposed substantially perpendicular to the inner wall portion;

wherein one of the contact members includes a fixed portion and a moving portion, the fixed portion affixing the contact member to the housing, the moving portion being displaceable with respect to the housing and mateable with the card ; and the inner wall portion includes a mating protrusion portion, the moving portion having a mating recessed portion that mates with the mating protrusion portion, and a protruding portion emanating from a bottom side thereof.

2. The connector of claim 1, wherein the fixed portion is affixed to the inner wall portion.

3. The connector of claim 2, wherein the moving portion is displaceable in a direction toward and away from the inner wall portion.

4. The connector of claim 3, wherein the moving portion is displaced when the card is inserted into the housing.

5. The connector of claim 1, wherein the moving portion includes a mating hole.

6. The connector of claim 5, wherein the mating hole mates with the mating protrusion portion.

7. The connector of claim 6, wherein the connector further comprises a sliding member, the sliding member holding the card upon insertion into the housing.

8. The connector of claim 7, wherein the connector further comprises a biasing member for, the biasing member biasing the sliding member in a direction opposite a card insertion direction.

9. The connector of claim 8, wherein the connector further comprises a card guiding mechanism, the card guiding mechanism moving the card, from an overstroke position, in a direction opposite the card insertion direction, and discharging the card when the card is held in a lock position.

10. The connector of claim 9, wherein a push operation, pushing the card held in the lock position, causes the card to move in the card insertion direction as far as the overstroke position.

* * * * *